US007530439B2

(12) United States Patent
Yamada et al.

(10) Patent No.: US 7,530,439 B2
(45) Date of Patent: May 12, 2009

(54) DRIVE DEVICE, SHEET CONVEYING DEVICE, AND IMAGE FORMING APPARATUS INCLUDING DRIVE FORCE TRANSMITTING UNIT INCLUDING REVERSE PREVENTING MECHANISM FOR PREVENTING SHAFT FROM BEING REVERSED

(75) Inventors: Mitsuru Yamada, Tokyo (JP); Yutaka Fukuchi, Yokohama (JP); Yuji Arai, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 399 days.

(21) Appl. No.: 11/081,591

(22) Filed: Mar. 17, 2005

(65) Prior Publication Data

US 2005/0230900 A1 Oct. 20, 2005

(30) Foreign Application Priority Data

Mar. 17, 2004 (JP) ..... 2004-077048

(51) Int. Cl.
*F16H 57/00* (2006.01)
*F16H 1/20* (2006.01)
*F16D 59/00* (2006.01)

(52) U.S. Cl. ..... 192/223.2; 74/411.5; 74/416

(58) Field of Classification Search ..... 192/223.2, 192/219.2, 219.3
See application file for complete search history.

(56) References Cited

U.S. PATENT DOCUMENTS 1,400,687 A * 12/1921 Kurtz ..... 475/272
RE17,489 E * 11/1929 Anderson ..... 192/219.3
2,003,963 A * 6/1935 Banker ..... 192/219.3
3,803,934 A * 4/1974 Yokel ..... 74/417
4,944,375 A * 7/1990 Ohta et al. ..... 192/223.2
2005/0230900 A1 10/2005 Yamada et al.

FOREIGN PATENT DOCUMENTS

JP 07-146606 6/1995
JP 07-168491 7/1995
JP 11-139626 5/1999

OTHER PUBLICATIONS

U.S. Appl. No. 11/081,591, filed Mar. 17, 2005, Yamada et al.
U.S. Appl. No. 11/210,661, filed Aug. 25, 2005, Yamada et al.
U.S. Appl. No. 11/247,269, filed Oct. 12, 2005, Uchiyama et al.

* cited by examiner

*Primary Examiner*—Rodney H Bonck
(74) *Attorney, Agent, or Firm*—Oblon, Spivak, McClelland, Maier & Neustadt, P.C.

(57) ABSTRACT

A drive device includes a first shaft, a second shaft disposed at a position deviated from a shaft line of the first shaft, a drive source that drives the first shaft to rotate, and a drive force transmitting unit connecting the first shaft to the second shaft via the drive force transmitting unit to transmit a drive force of the drive source from the first shaft to the second shaft. The drive force transmitting unit includes a reverse preventing mechanism that prevents the first shaft from being rotated in a reverse direction. The reverse preventing mechanism includes a one-way clutch, and the drive force transmitting unit further includes a reduction mechanism that reduces a rotational speed of the one-way clutch to be lower than a rotational speed of the first shaft.

11 Claims, 11 Drawing Sheets

DRIVE DEVICE, SHEET CONVEYING DEVICE, AND IMAGE FORMING APPARATUS INCLUDING DRIVE FORCE TRANSMITTING UNIT INCLUDING REVERSE PREVENTING MECHANISM FOR PREVENTING SHAFT FROM BEING REVERSED

CROSS-REFERENCE TO RELATED APPLICATIONS

This application claims priority to Japanese Patent Application No. 2004-077048 filed in the Japanese Patent Office on Mar. 17, 2004, the entire contents of which is hereby incorporated herein by reference.

BACKGROUND OF THE INVENTION

1. Field of the Invention

The present invention relates to a drive device including a reverse preventing mechanism that prevents a roller shaft from being rotated in a reverse direction. The present invention further relates to a sheet conveying device using the drive device, and an image forming apparatus such as a copying machine, a facsimile machine, a laser beam printer, or other similar image forming apparatus, including the sheet conveying device.

2. Discussion of the Background

In an image forming apparatus such as a copying machine, a facsimile machine, a laser beam printer, or other similar image forming apparatus, it is necessary to prevent sheet conveying rollers from being reversed for various reasons. For example, to correct a skew feed of a sheet, a leading edge of the sheet is abut against a nip portion of a pair of registration rollers, and the sheet is conveyed for some distance by sheet conveying rollers disposed upstream of the registration rollers in a sheet conveying direction to form a loop of the sheet. At this time, if a reverse preventing mechanism for preventing the sheet conveying rollers from being reversed is not provided, the sheet conveying rollers are rotated in a reverse direction (i.e., in the direction opposite to the sheet conveying direction) due to a tension of the sheet. As a result, the loop of the sheet disappears, resulting in an inferior sheet skew correction. At worst, the leading edge of the sheet goes back from the nip portion of the registration rollers toward the sheet conveying rollers, so that a mis-feeding of the sheet occurs. Generally, a sheet separation roller is disposed upstream of the sheet conveying rollers in the sheet conveying direction, which rotates in a reverse direction to separate the uppermost sheet from the sheets fed out from a sheet feeding cassette. The above-described inferior sheet skew correction and mis-feeding of sheets are typically caused when a force is exerted in a sheet returning-back direction.

To obviate the above-described problems, a reverse preventing mechanism for preventing sheet conveying rollers from being reversed is provided in an apparatus that performs a sheet conveying operation. FIGS. 1, 2A, and 2B illustrate a background reverse preventing mechanism for sheet conveying rollers used in an image forming apparatus. A roller clutch (one-way clutch) 100 illustrated in FIG. 1 is generally used as a reverse preventing mechanism. In the configuration of the roller clutch 100, each of a plurality of needle pins 120 is disposed in a hole-shaped clearance 140 (FIG. 2A) formed between the circumferential surface of a roller shaft 135 and an outer ring 160 such that the plurality of needle pins 120 contact the circumferential surface of the roller shaft 135. As illustrated in FIG. 2B, the clearance 140 includes a narrow width portion B and a wide width portion C. Regularly, each of the needle pins 120 is biased by a spring 150 toward the narrow width portion B of the clearance 140. The size of the clearance 140 is set such that the needle pin 120 can be prevented from falling through the clearance 140.

In this configuration of the roller clutch 100, when the roller shaft 135 is rotated in a direction indicated by arrow A in FIGS. 2A and 2B (i.e., a counter-clockwise direction), the needle pin 120 moves toward the narrow width portion B of the clearance 140 due to friction between the needle pin 120 and the roller shaft 135. By catching the needle pin 120 in the narrow width portion B of the clearance 140, the roller shaft 135 and the roller clutch 100 are locked as illustrated in FIG. 2B. When the roller shaft 135 is rotated in a reverse direction (i.e., a clockwise direction), the needle pin 120 moves toward the wide width portion C of the clearance 140 by overcoming the biasing force of the spring 150, and thereby the roller shaft 135 rotates freely in the clockwise direction. The outer ring 160 is disposed between the roller clutch 100 and a holder 130, and has a function of positioning the holder 130 relative to the roller clutch 100.

FIG. 3 is a schematic view of a sheet conveying roller mechanism provided with the background reverse preventing mechanism for use in an image forming apparatus. As illustrated in FIG. 3, a plurality of sheet conveying rollers 103 are attached on a roller shaft 135 rotatably disposed between side plates 131 and 132 via bearings 133 and 134, respectively. A plurality of driven rollers 137 attached on a driven shaft 136 contact the sheet conveying rollers 103 with a predetermined pressure, respectively, to convey a sheet without fail by applying a frictional force to the sheet at the nip portions between the sheet conveying rollers 103 and the driven rollers 137. As illustrated in FIG. 3, the roller clutch 100 is often used as a bearing by pressing the roller clutch 100 into the bearing 134 that supports one side of the roller shaft 135.

In the above-described sheet conveying roller mechanism provided with the roller clutch 100, the following problems typically arise. Generally, to convey sheets, the sheet conveying rollers 103 convey sheets by use of a frictional force produced by contacting the driven rollers 137 with the sheet conveying rollers 103 with a predetermined pressure as described above. Accordingly, a load is generated in the roller shaft 135 in its radial direction. Thereby, the roller shaft 135 is pressed against the needle pins 120, and the needle pins 120 are pressed against the outer ring 160 facing the clearance 140. The rotation and halt of the roller shaft 135 are repeated in this condition.

Although a rust preventing oil is applied to the needle pins 120, it is difficult to use a lubricating oil because a slip occurs at the time of halt (locking) of the roller clutch 100. The needle pins 120 are generally formed from a hard material of iron and steel and are subjected to quench hardening in view of the needle pins 120 abrading over time. In the above-described use conditions of the roller clutch 100, the roller shaft 135 wears over time, and abrasion powders accumulate in the roller clutch 100. The diameter of the roller shaft 135 decreases, and/or abrasion powders enter portions between the roller shaft 135 and the needle pins 120. As a result, the roller shaft 135 becomes unable to be locked, an abnormal noise is produced, and a useful life of the roller shaft 135 decreases. The roller shaft 135 may be subjected to quench hardening to extend its useful lifetime. However, because the roller shaft 135 needs to be formed from a special stainless material free from rusting, subjecting the roller shaft 135 to quench hardening increases the cost of the roller shaft 135.

Further, as the length of the roller shaft 135 is generally greater than a width of a sheet, the cost of the roller shaft 135 increases that much more.

In addition to the above-described problems, in a high-speed apparatus in which a rotational speed of the roller shaft 135 is high, heat produced by friction between the needle pins 120 and the roller shaft 135 and heat produced by friction between the needle pins 120 and the outer ring 160 facing the clearances 140 increase. As a result, seizing up of metallic members typically occurs, and an abnormal noise tends to be produced.

In an image forming apparatus, the sheet conveying rollers 103 and an image forming device are generally disposed between the pair of side plates 131 and 132. A drive system such as gears, motors, and clutches is disposed at the outside of one of the side plates 131 and 132. Such a drive system may be disposed on each side of the side plates 131 and 132 instead of one side thereof. However, because wires and gear trains used for a motor and reduction gears need a predetermined space for their layouts, if such a drive system is disposed on each side of the side plates 131 and 132, the width of the apparatus increases. Therefore, the layout of a drive system concentrates on one side of the apparatus.

In a recent space-saving printer or multi-function apparatus, the space for the layout of units is restricted, and therefore some units need to be disposed on a side opposite from a drive source relative to a sheet conveying area. For example, a waste toner tank may be applied to this case. The waste toner tank is preferably disposed at the outside of one of the side plates 131 and 132 for easy maintenance. On the side where a drive system is provided, a motor, a structure for supporting the motor, and shafts for transmitting a drive force of the motor to each unit are disposed. Further, a waste toner conveying path for conveying waste toner from an image forming device, which is disposed between the side plates 131 and 132, to the waste toner tank needs to protrude through one of the side plates 131 and 132. Therefore, it is difficult to dispose the drive system and the waste toner tank on the same side of one of the side plates 131 and 132.

To drive a unit such as a waste toner tank disposed on a side opposite from a first drive source such as a motor, a second drive source needs to be provided on a side opposite from the first drive source. In this case, it costs extra money for a motor, a driver, attaching parts, and electric wires. Further, measures against waves and noises produced from electric wires and motors need to be taken on the both sides of the side plates 131 and 132.

Moreover, to enhance maintenance of a waste toner tank in an image forming apparatus, it is desirable that the waste toner tank is disposed at the outside of a side plate located on a side opposite from a drive system. This location of the waste toner tank is convenient for a user who replaces the full waste toner tank. Generally, the maintenance of a drive system is conduced by a customer engineer for safety. Further, a user replaces a photoreceptor/cleaning unit (PCU) and an intermediate transfer belt unit, for example, by opening a cover disposed on a side opposite from the drive system. It is preferable that the number of covers to be opened for maintenance is reduced to a minimum. Therefore, the same cover to be opened for maintenance is preferably shared among the waste toner tank, the PCU, and the intermediate transfer belt unit.

SUMMARY OF THE INVENTION

In view of the above-noted recognized drawbacks in the background art, it is desirable to provide a drive device, a sheet conveying device using the drive device, and an image forming apparatus including the sheet conveying device that can use a reverse preventing mechanism preventing at least one sheet conveying roller from being reversed and having a high durability without increasing costs.

Further, it is desirable to provide a drive device, a sheet conveying device using the drive device, and an image forming apparatus including the sheet conveying device in which a waste toner tank can be driven without providing a drive source on the installation side of the waste toner tank and without requiring extra costs.

The present invention can provide a novel drive device including a first shaft, a second shaft disposed at a position deviated from a shaft line of the first shaft, a drive source configured to drive the first shaft to rotate, and a drive force transmitting unit connecting the first shaft to the second shaft via the drive force transmitting unit to transmit a drive force of the drive source from the first shaft to the second shaft. The drive force transmitting unit includes a reverse preventing mechanism configured to prevent the first shaft from being rotated in a reverse direction.

The reverse preventing mechanism may include a one-way clutch, and the drive force transmitting unit may further include a reduction mechanism configured to reduce a rotational speed of the one-way clutch to be lower than a rotational speed of the first shaft.

The present invention can further provide a novel sheet conveying device including at least one sheet conveying roller configured to convey a sheet, a first shaft on which the at least one sheet conveying roller is attached, a second shaft disposed at a position deviated from a shaft line of the first shaft, a drive source configured to drive the first shaft to rotate, and a drive force transmitting unit connecting the first shaft to the second shaft via the drive force transmitting unit to transmit a drive force of the drive source from the first shaft to the second shaft. The drive force transmitting unit includes a reverse preventing mechanism configured to prevent the first shaft from being rotated in a reverse direction.

The reverse preventing mechanism may include a one-way clutch, and the drive force transmitting unit may further include a reduction mechanism configured to reduce a rotational speed of the one-way clutch to be lower than a rotational speed of the first shaft.

The present invention can further provide a novel image forming apparatus including the above-described novel sheet conveying device and a novel image forming device configured to form an image on the sheet conveyed by the sheet conveying device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
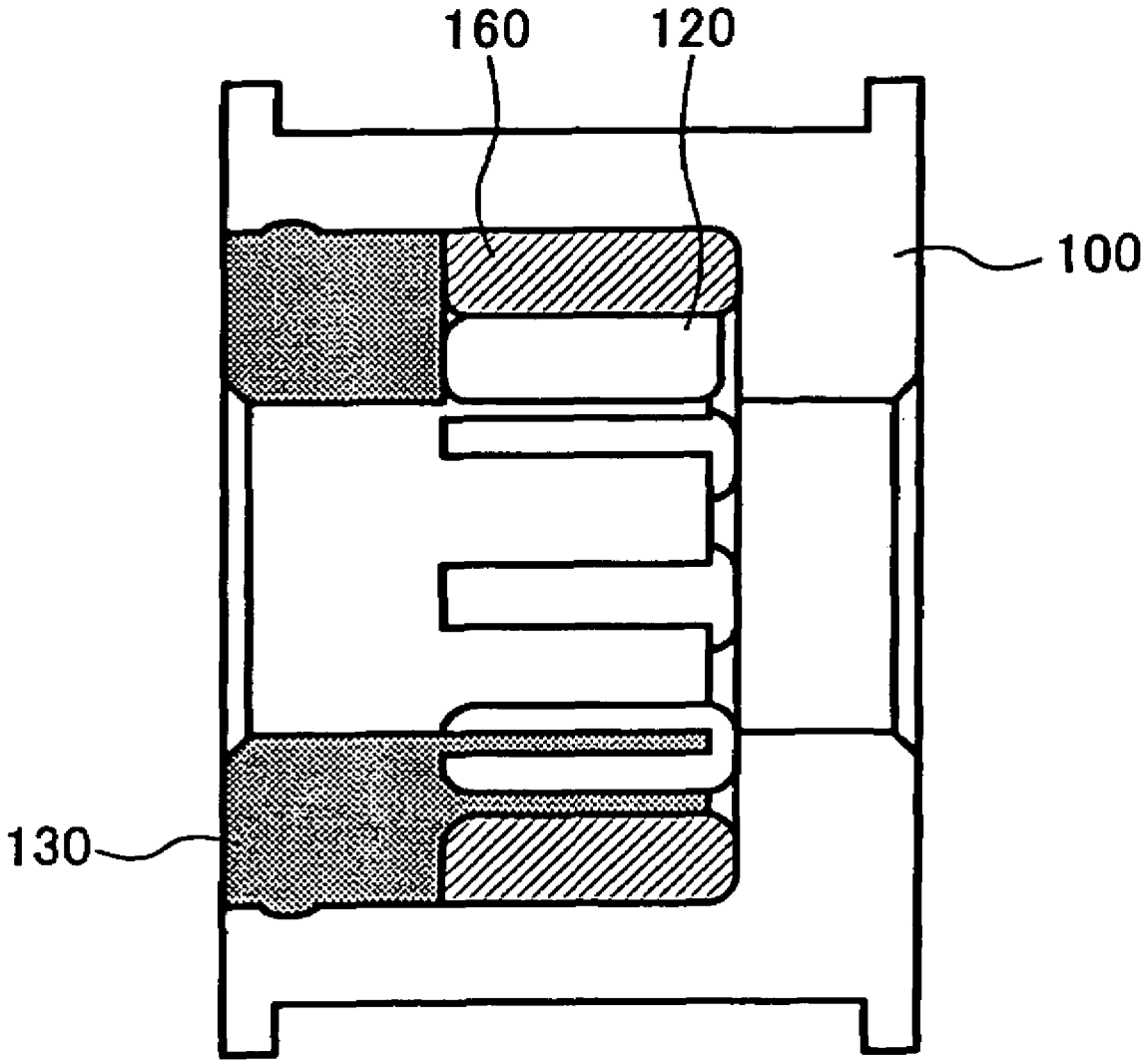
FIG. 1 BACKGROUND ART
FIG. 1 is a vertical sectional view of a background reverse preventing mechanism for sheet conveying rollers used in a background image forming apparatus.

Preferred embodiments of the present invention are described with reference to the drawings, wherein like reference numerals designate identical or corresponding parts throughout the views.

Figure 4:
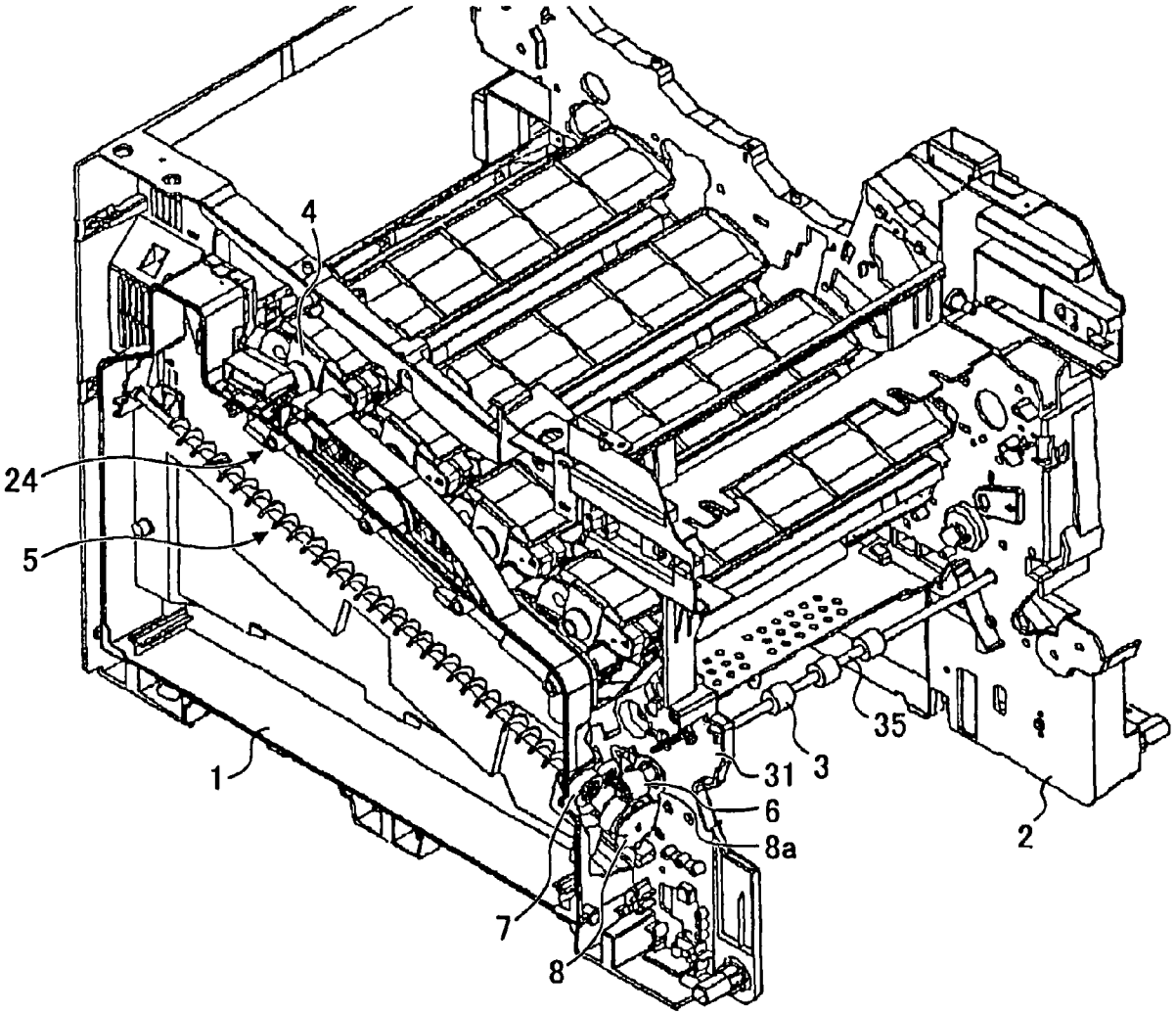
FIG. 4 is a perspective view of an image forming apparatus seen from the left side thereof according to an embodiment of the present invention.
Figure 7:
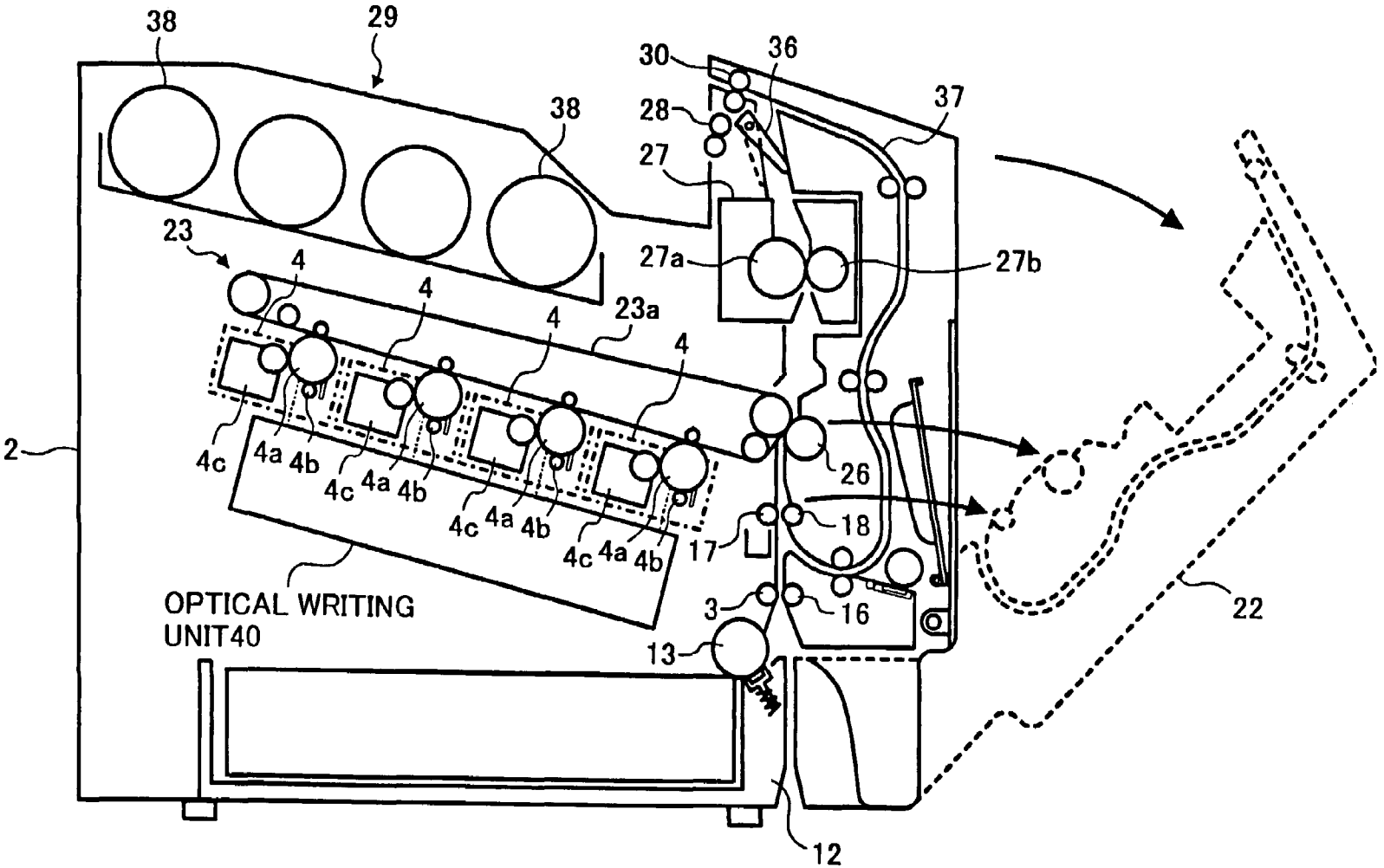
FIG. 7 is a vertical sectional view of the image forming apparatus to which a sheet feeding tray is attached according to the embodiment of the present invention.

FIG. 4 is a perspective view of an image forming apparatus seen from the left side thereof according to an embodiment of the present invention. The image forming apparatus of the present embodiment is constructed from a main body frame 2 formed from resin. Units and parts of the image forming apparatus are attached to the main body frame 2. As illustrated in FIGS. 4 and 7, four process cartridges 4 corresponding to four color toners are detachably attached to the main body frame 2. Each of the process cartridges 4 includes a photoreceptor 4*a*, a charging roller 4*b*, a developing device 4*c*, and a cleaning device (not shown). However, the construction of the process cartridge 4 is not limited to that shown in FIG. 7. The four process cartridges 4 are attached to and detached from the main body frame 2 from the left side of the image forming apparatus in FIG. 4 and from the front side of the image forming apparatus in a direction perpendicular to the sheet of FIG. 7. Therefore, the maintenance of the apparatus and replacements of parts can be easily and smoothly carried out. With reference to FIG. 7, an intermediate transfer belt unit 23 is detachably attached to the main body frame 2 above the process cartridges 4. Like the process cartridges 4, the intermediate transfer belt unit 23 is attached to and detached from the main body frame 2 from the front side of the image forming apparatus in a direction perpendicular to the sheet of FIG. 7. Further, an optical writing unit 40 is provided below the process cartridges 4 to form a latent image on the photoreceptor 4*a* of each of the process cartridges 4.

As illustrated in FIG. 4, a waste toner tank 1 is attached to the left side surface of the main body frame 2. In FIG. 4, the left side part of the image forming apparatus is cut away and opened. The toner removed from each of the photoreceptors 4*a* in the process cartridges 4 is collected in the waste toner tank 1 through a waste toner pipe 24. The waste toner tank 1 is replaced by opening a left cover (not shown) of the apparatus. The waste toner tank 1 is configured to store four color toners. To even the height of toner accumulated in the waste toner tank 1, an auger 5 is disposed at the upper portion of the waste toner tank 1 to move the waste toner leftward in FIG. 4.

Figure 5:
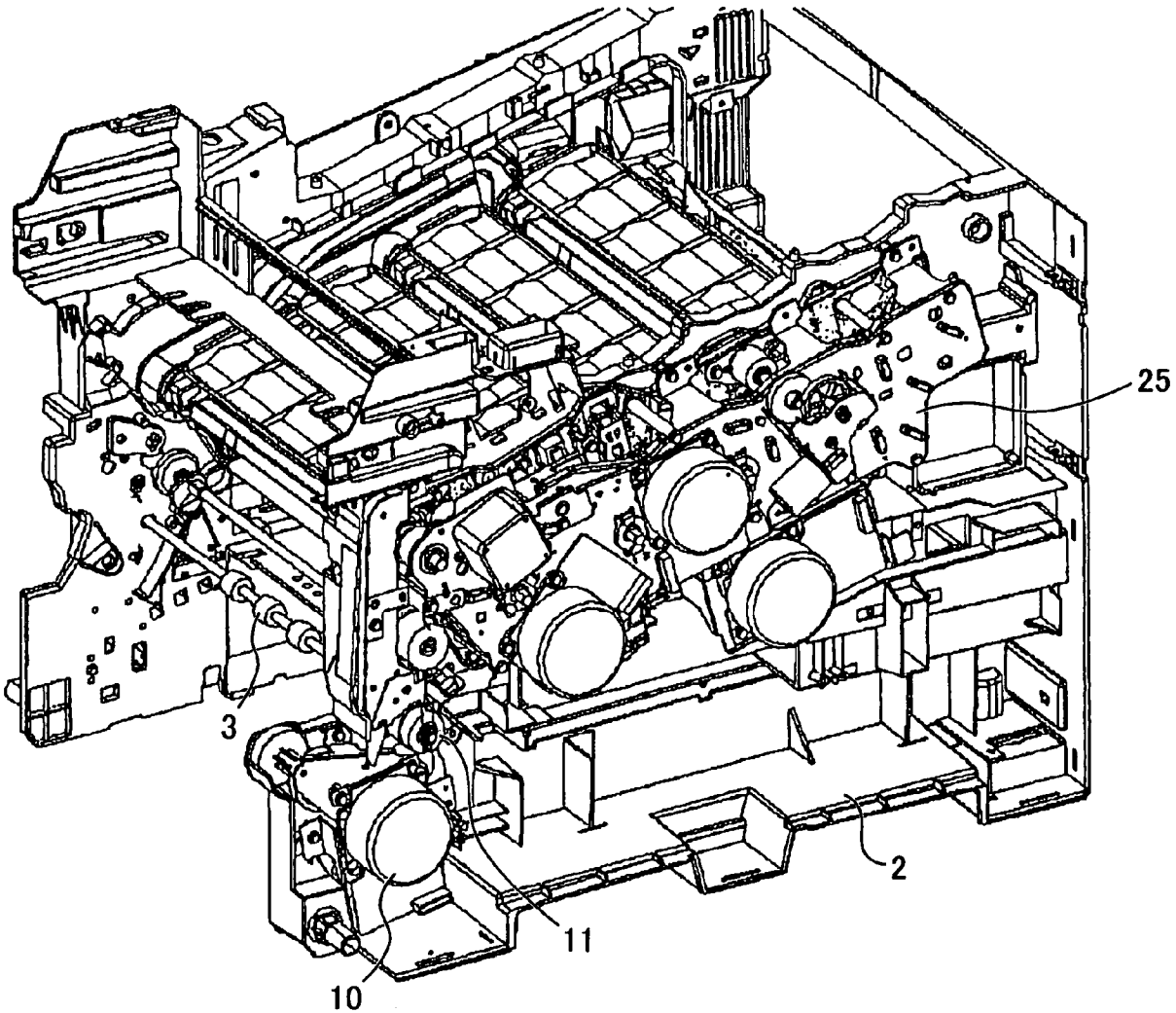
FIG. 5 is a perspective view of the image forming apparatus seen from the right side thereof according to the embodiment of the present invention.

A roller shaft 35 is disposed to cross a center opening portion of the main body frame 2. A plurality of sheet conveying rollers 3 are attached on the roller shaft 35. A drive force transmitting unit (described below) including a one-way clutch for transmitting a drive force to the auger 5 is disposed on the left end side of the roller shaft 35 in FIG. 4, and a drive system 25 for driving an image forming device (described below) of the image forming apparatus is disposed on the right end side of the roller shaft 35 as illustrated in FIG. 5.

Figure 6:
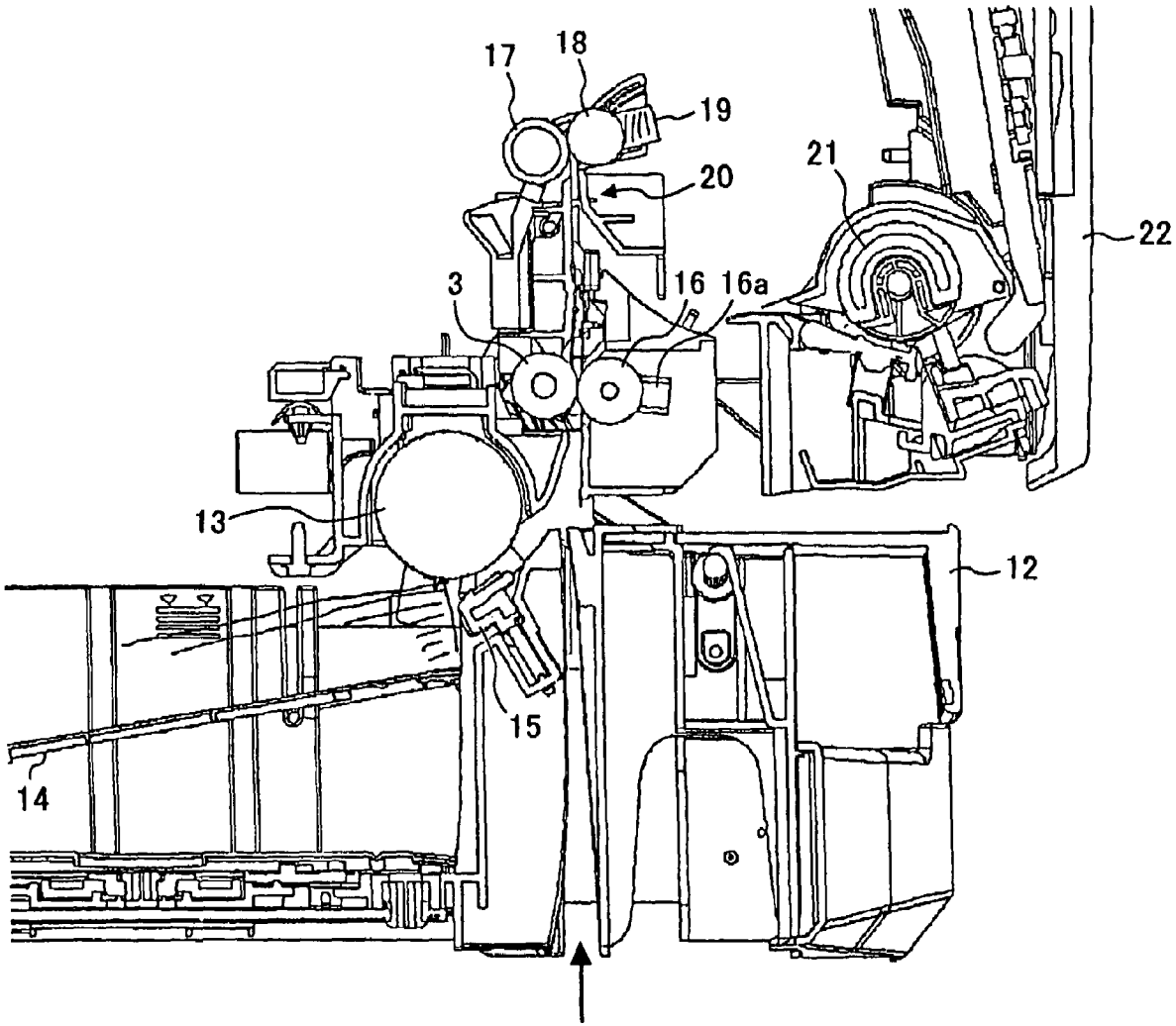
FIG. 6 is a mid-sectional view of a sheet conveying section of the image forming apparatus according to the embodiment of the present invention.

FIG. 6 illustrates a main portion of a sheet conveying mechanism including a sheet feeding tray when a front cover of the image forming apparatus is opened. A sheet feeding tray 12 is disposed below the main body frame 2. The sheets stacked on a bottom plate 14 of the sheet feeding tray 12 are pressed toward a sheet feeding roller 13 by a spring (not shown), and the uppermost sheet of the stacked sheets contacts the sheet feeding roller 13 with pressure. Further, a friction pad 15 acting as a sheet separating member contacts a circumferential surface of the sheet feeding roller 13. When plural sheets abut on the friction pad 15, the sheets other than the uppermost sheet are caused to stop proceeding due to friction caused by the friction pad 15. The sheet feeding roller 13 is rotated by a sheet feeding motor 10 via an electromagnetic clutch 111 illustrated in FIG. 5 to feed sheets toward the sheet conveying rollers 3 at a predetermined timing.

Figure 10:
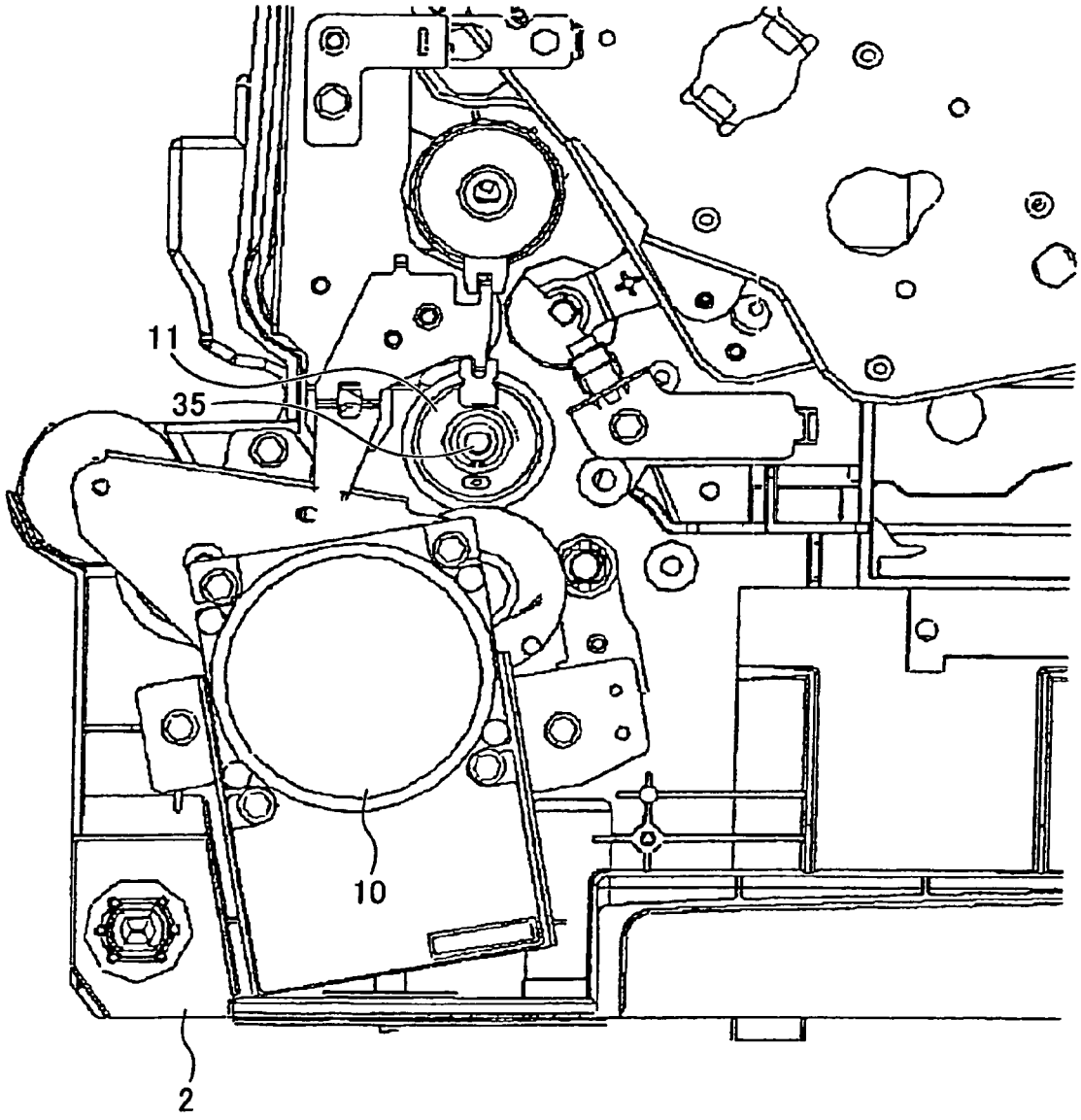
FIG. 10 is a right side view of a connecting section between a roller shaft of the sheet conveying rollers and a drive source for driving the sheet conveying rollers according to the embodiment of the present invention.

As illustrated in FIG. 4, the roller shaft 35 is rotatably supported by the main body frame 2 via two bearings (not shown). The roller shaft 35 is formed from steel such as nickel-plated mild steel (SUM), and is inserted into the sheet conveying rollers 3 formed from ethylene propylene rubber. With reference to FIGS. 5 and 10, a drive force of the sheet feeding motor 10 disposed on the right side of the main body frame 2 is transmitted to the roller shaft 35 and the sheet conveying rollers 3 via the electromagnetic clutch 11. The sheet conveying rollers 3 convey the sheet fed from the sheet feeding roller 13 toward a registration drive roller 17 and a registration driven roller 18 (illustrated in FIGS. 6 and 7) disposed at an upper side relative to the sheet conveying rollers 3 in the image forming apparatus, that is at the downstream side of the sheet conveying rollers 3 in a sheet conveying direction. The registration driven roller 18 is biased toward the registration drive roller 17 with a predetermined pressure by a spring 19 (illustrated in FIG. 6) to apply a predetermined contact pressure to the sheet.

After a registration sensor 20 (illustrated in FIG. 6) disposed upstream of the registration drive roller 17 and the registration driven roller 18 in the sheet conveying direction detects the leading edge of the sheet conveyed by the sheet conveying rollers 3, the sheet conveying rollers 3 convey the sheet by a distance in which several extra millimeters are added on the distance between the registration sensor 20 and the nip portion between the registration drive roller 17 and the registration driven roller 18. By this arrangement, the leading edge of the sheet is abut against the nip portion between the registration drive roller 17 and the registration driven roller 18, and the sheet stops proceeding and forms a loop. As a result, the leading edge of the sheet is aligned, so that a sheet skew is corrected. A reference numeral 16 in FIGS. 6 and 7 indicates a driven roller pairing up with each of the sheet conveying rollers 3. The driven roller 16 is biased toward the sheet conveying roller 3 with a predetermined pressure by a spring 16*a* (illustrated in FIG. 6) to apply a predetermined contact pressure to the sheet. A reference numeral 21 in FIG. 6 indicates a manual feeding roller provided to a front cover 22. The front cover 22 is swingably supported by the lower end of the main body frame 2.

The front cover 22 is closed at the time of feeding sheets. The registration drive roller 17, the sheet conveying rollers 3, and the sheet feeding roller 13 are started to rotate in alignment with a timing of forming a latent image on the photoconductive drum 4*a*. The sheet feeding roller 13 stops rotating after feeding a trailing edge portion of a sheet. The sheet conveying rollers 3 keep rotating until a loop of the sheet is formed. The registration drive roller 17 stops at a predetermined timing when the registration sensor 20 detects the leading edge of the sheet to perform a sheet skew correction. Thus, when a sheet is fed out and conveyed from the sheet feeding tray 12, the sheet conveying rollers 3 keep rotating except when a loop of the sheet is formed for a sheet skew correction. The sheet having passed through the nip portion between the registration drive roller 17 and the registration driven roller 18 is conveyed toward an image transfer section along a sheet guide plate (not shown). Subsequently, images of different colors formed on an intermediate transfer belt 23*a* of the intermediate transfer belt unit 23 are sequentially transferred to the sheet conveyed by the registration drive roller 17 and the registration driven roller 18 while being superimposed on one another.

With reference to FIG. 7, a transfer roller 26 is provided downstream of the registration drive roller 17 and the registration driven roller 18 in the sheet conveying direction. The transfer roller 26 is used when transferring images formed on the intermediate transfer belt 23*a* to a sheet conveyed by the registration drive roller 17 and the registration driven roller 18. Further, a fixing device 27 is provided downstream of the transfer roller 26 in the sheet conveying direction. The fixing device 27 includes a fixing roller 27*a* and a pressure roller 27*b*. While a sheet passes through a nip portion between the fixing roller 27*a* and the pressure roller 27*b*, a transferred image is fixed onto the sheet by heat and pressure. The sheet having the fixed image is discharged by a pair of sheet discharging rollers 28 to a sheet discharging tray 29. In the image forming apparatus of the present embodiment, an image forming device that forms an image on a sheet is configured by the optical writing unit 40, the process cartridges 4, the intermediate transfer belt unit 23, the transfer roller 26, the fixing device 27, etc., for example.

The image forming apparatus has a configuration that allows images to be formed on dual sides (the first and second sides) of a sheet. When a dual-side image-forming mode is selected, the sheet passed through the fixing device 27 is directed to a reversing mechanism. The reversing mechanism includes a pair of reversing rollers 30, a separation pick 36, and a sheet conveying path 37. When forming images on dual sides of a sheet, the separation pick 36 moves to the position illustrated by dotted lines in FIG. 7. Then, by the rotations of the reversing rollers 30, the sheet is reversed and conveyed to the sheet conveying path 37. The reversed sheet is conveyed toward the registration drive roller 17 and the registration driven roller 18 while passing through the sheet conveying path 37. Subsequently, the registration drive roller 17 and the registration driven roller 18 feed the sheet to the nip portion between the intermediate transfer belt 23*a* and the transfer roller 26 again. The images of different colors that have been formed on the intermediate transfer belt 23*a* are sequentially transferred to the rear side of the sheet at the nip portion between the intermediate transfer belt 23*a* and the transfer roller 26 while being superimposed on one another.

The above-described reversing mechanism, the transfer roller 26, the registration driven roller 18, and the manual feeding roller 21 are provided to the front cover 22. A sheet conveying path for conveying a sheet fed out from the sheet feeding tray 12 is formed by closing the front cover 22. Further, toner bottles 38 containing respective color toners are provided below the sheet discharging tray 29. The toner bottles 38 can be replaced by opening the sheet discharging tray 29. That is, the sheet discharging tray 29 also acts as an upper cover of the image forming apparatus.

Figure 8:
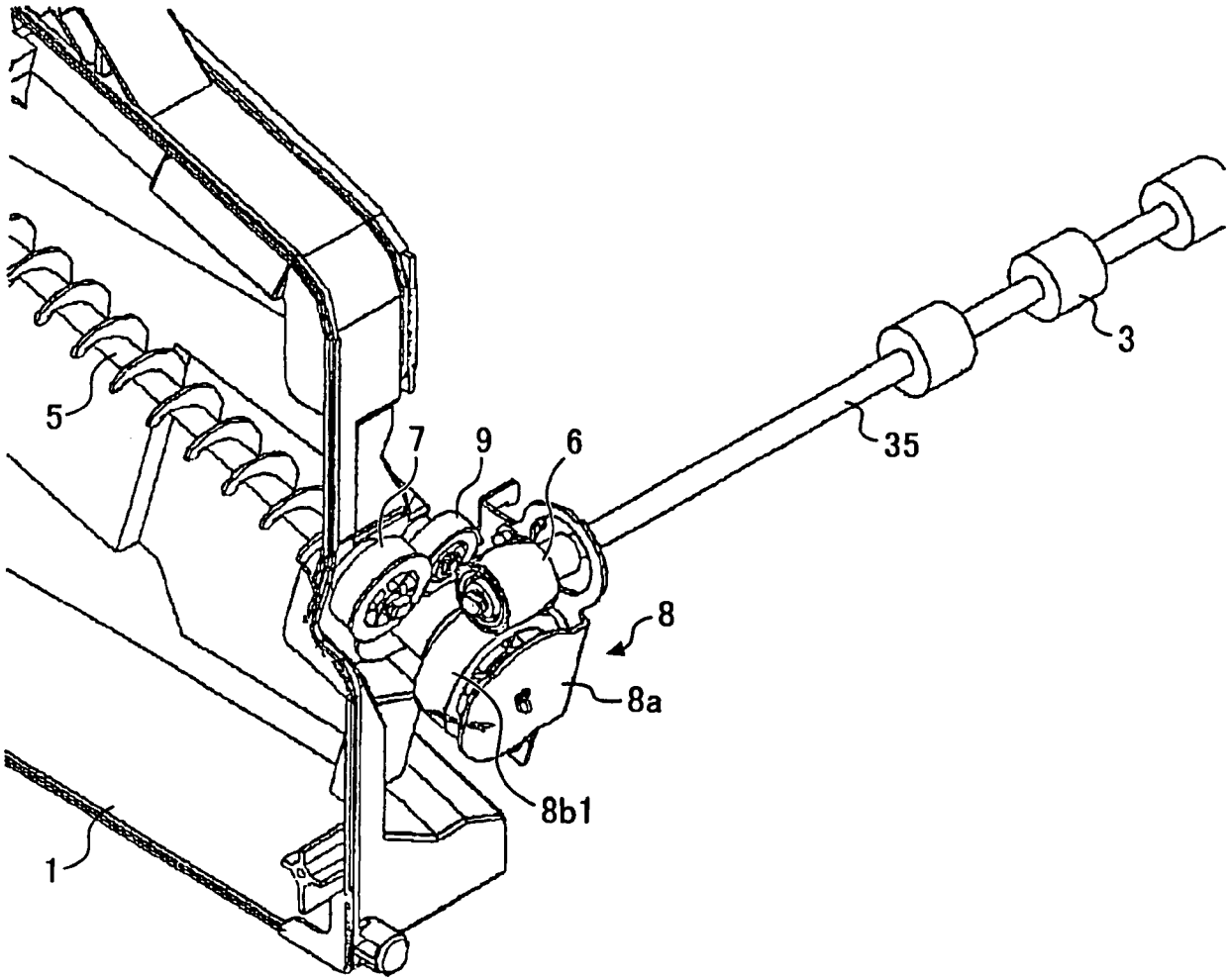
FIG. 8 is a perspective view of sheet conveying rollers, a drive force transmitting unit including a reverse preventing mechanism, and a waste toner tank according to the embodiment of the present invention.

As illustrated in FIG. 8, a helical gear 6 is attached on the left-side end portion of the roller shaft 35 of the sheet conveying rollers 3, and rotates unitarily with the roller shaft 35. The helical gear 6 has a twist angle of about 45 degrees with respect to its rotational axis. The helical gear 6 is connected to an idler unit 8.

Figure 2A:
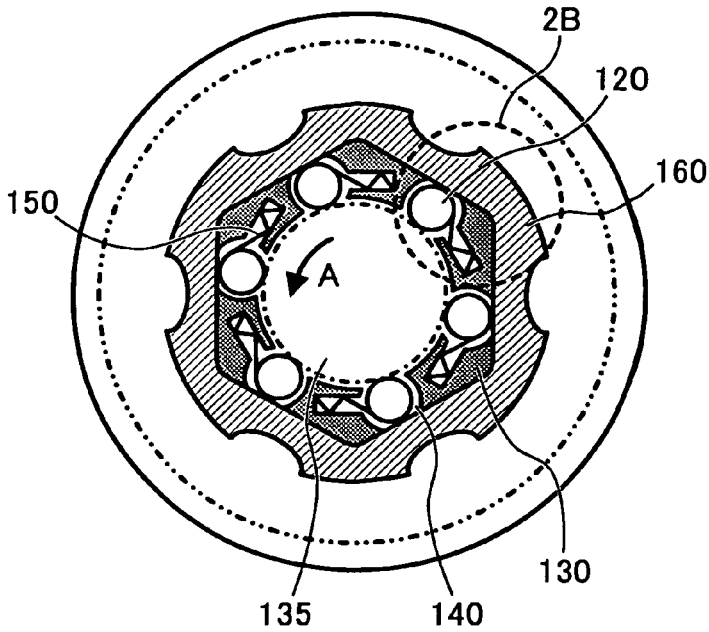
FIG. 2A BACKGROUND ART
FIG. 2A is a transverse sectional view of the background reverse preventing mechanism of FIG. 1.
Figure 2B:
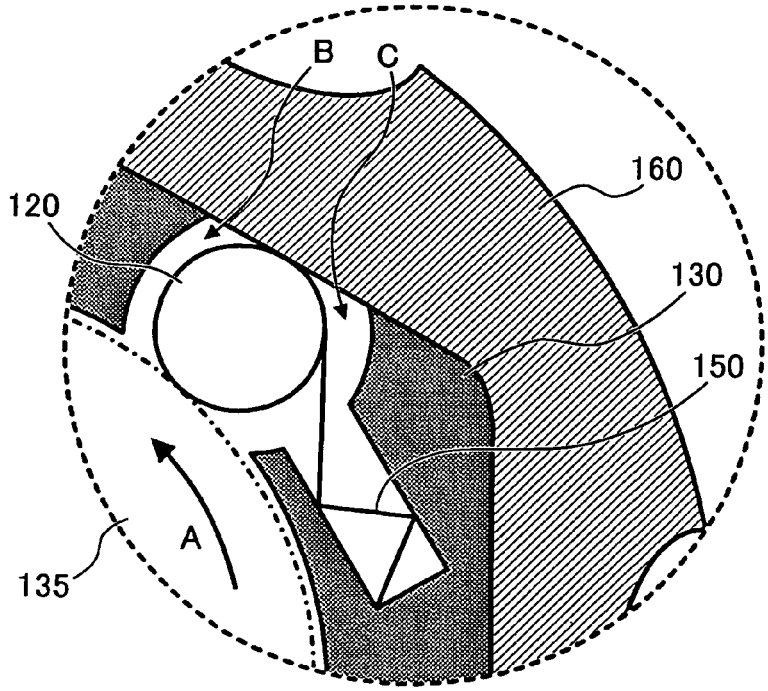
FIG. 2B BACKGROUND ART
FIG. 2B is an enlarged sectional view of a part of the background reverse preventing mechanism of FIG. 2A.
Figure 3:
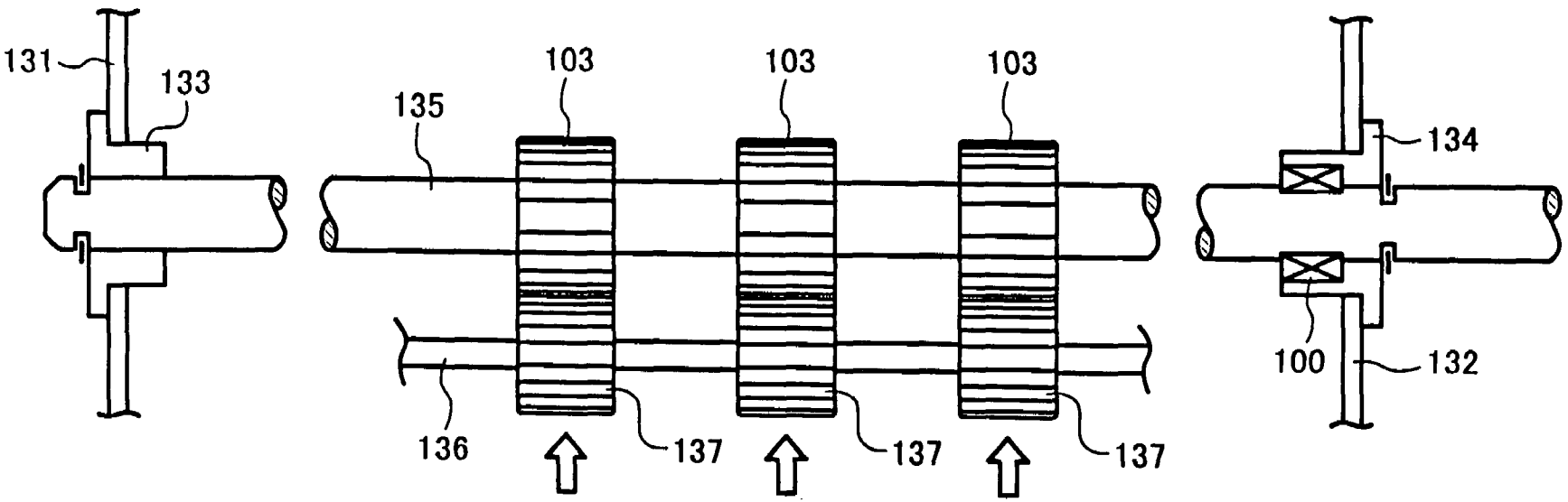
FIG. 3 BACKGROUND ART
FIG. 3 is a schematic view of a sheet conveying mechanism provided with the background reverse preventing mechanism for use in a background image forming apparatus.
Figure 9:
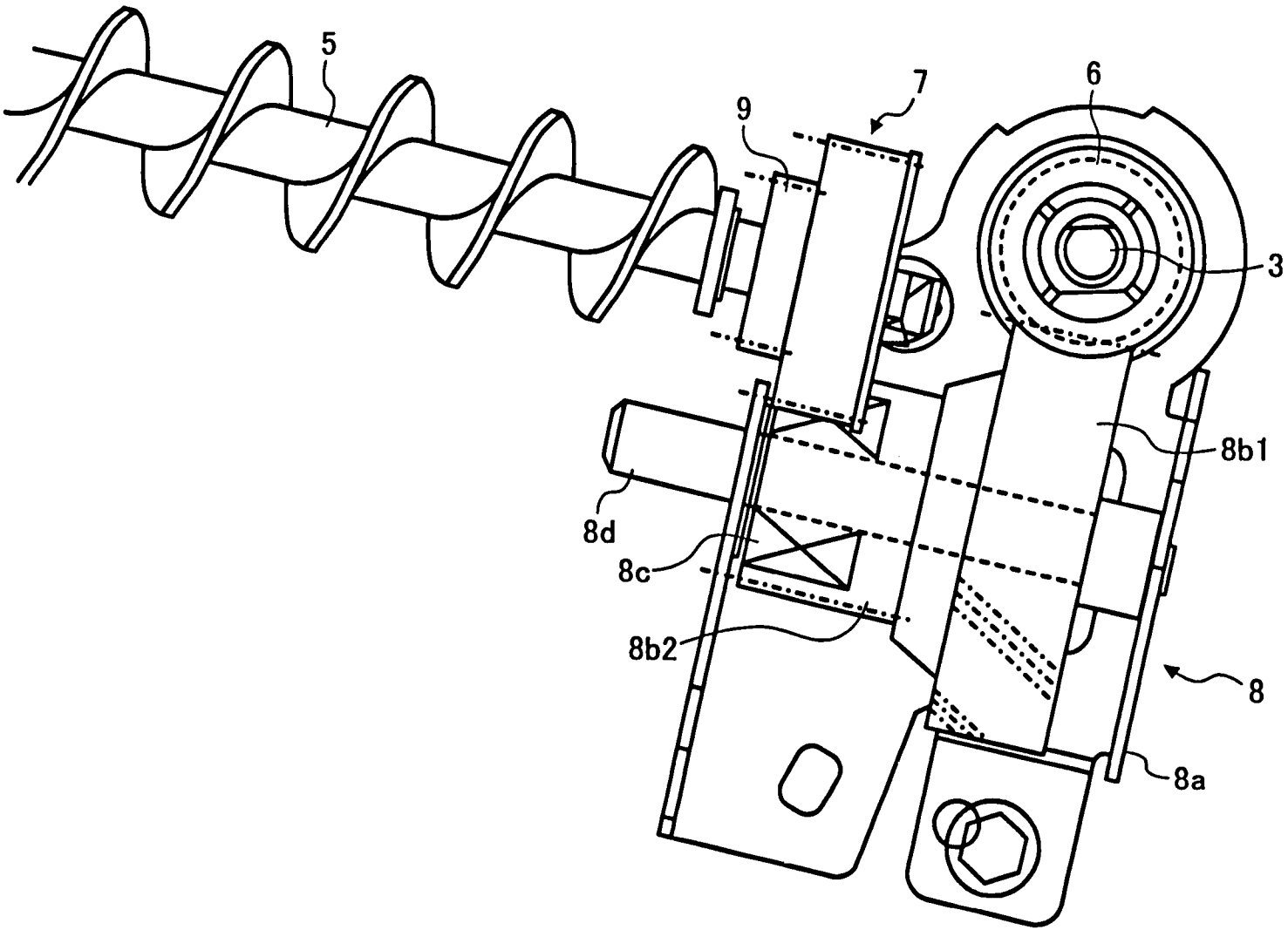
FIG. 9 is a left side view of the drive force transmitting unit and a drive section for driving the waste toner tank according to the embodiment of the present invention.
Figure 11:
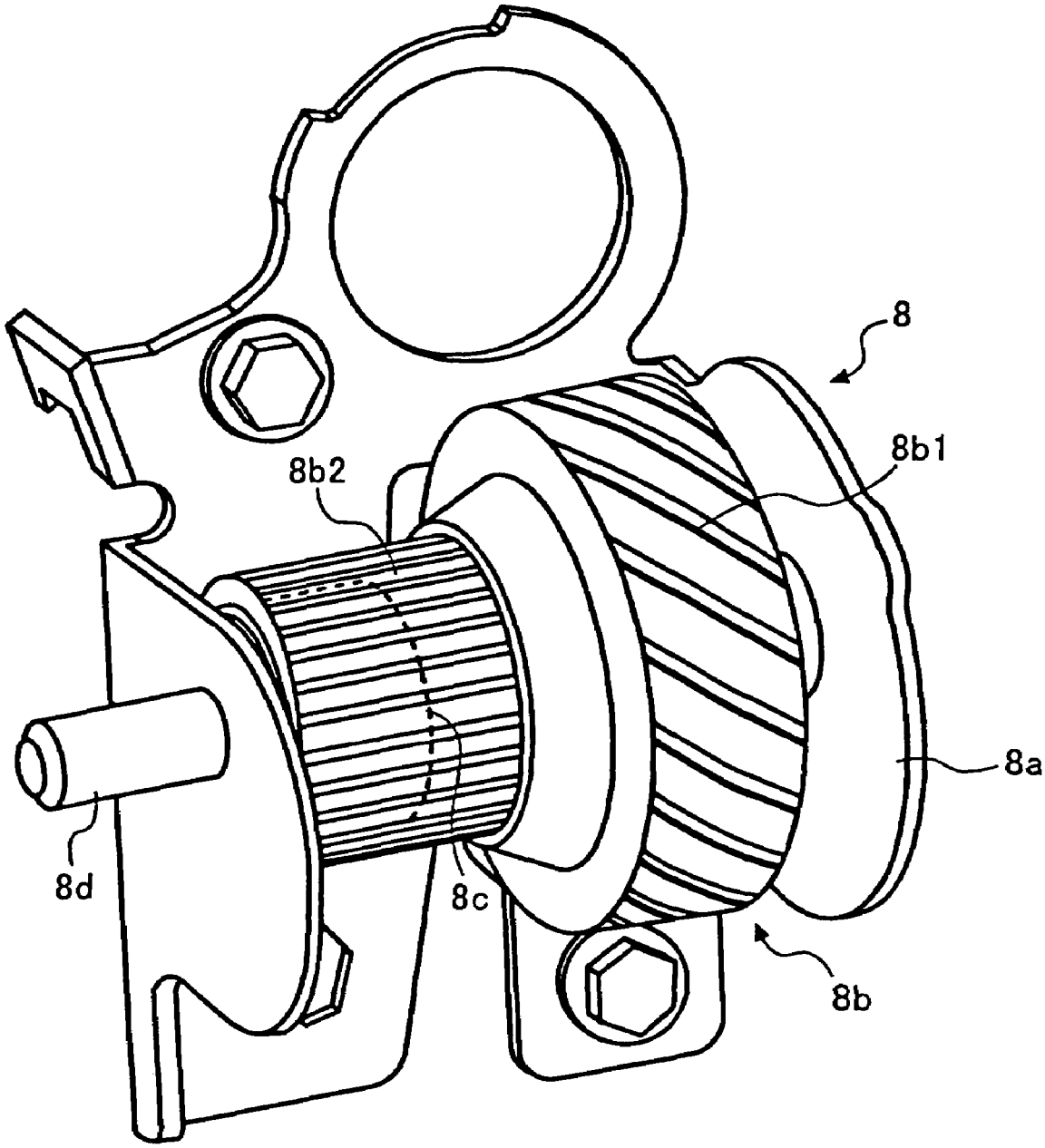
FIG. 11 is a perspective view of an idler unit acting as the drive force transmitting unit according to the embodiment of the present invention.

As illustrated in FIGS. 9 and 11, the idler unit 8 includes a bracket 8*a* formed from a sheet metal, a shaft 8*d* fixed to the bracket 8*a*, and double gears 8*b* that rotate around the shaft 8*d*. The double gears 8*b* include a helical gear 8*b*1 having a twist angle of about 45 degrees with respect to its rotational axis, and a spur gear 8*b*2. The helical gear 8*b*1 and the spur gear 8*b*2 are unitarily formed. The spur gear 8*b*2 unitarily formed with the helical gear 8*b*1 is attached on the shaft 8*d* via a one-way clutch (roller clutch) 8*c*. A single unit is configured by the bracket 8*a*, the double gears 8*b*, the one-way clutch 8*c*, and the shaft 8*d*. The idler unit 8 is assembled by the following steps. After forming the bracket 8*a* from a sheet metal, the double gears 8*b* and the one-way clutch 8*c* are inserted into a space between two supporting portions of the bracket 8*a*. Next, after inserting the shaft 8*d* into the double gears 8*b* and the one-way clutch 8*c* through one of the supporting portions of the bracket 8*a*, two portions of the shaft 8*d* are crimped onto the two supporting portions of the bracket 8*a*, respectively. The one-way clutch 8*c* is similar to the roller clutch 100 described with reference to FIGS. 1 through 3.

As illustrated in FIG. 4, the bracket 8*a* is attached to the front end side of a side plate 31 disposed on the left side of the image forming apparatus in FIG. 4. The helical gear 6 attached on the end portion of the roller shaft 35, which is rotatably supported by the side plate 31, protrudes from the side plate 31 leftward in FIG. 4 and engages the helical gear 8*b*1 of the double gears 8*b*. Specifically, in the bracket 8*a*, the helical gear 8*b*1 having a twist angle of about 45 degrees and the helical gear 6 having a twist angle of about 45 degrees are engaged with each other, and the drive force of the sheet feeding motor 10 is transmitted from the roller shaft 35 to the shaft of the auger 5 which are in a cross positional relationship at about 90 degrees. By this arrangement, as illustrated in FIGS. 8 and 9, the spur gear 8*b*2 of the double gears 8*b* engages a gear 7 attached on an end portion of a shaft of the auger 5 of the waste toner tank 1 via an idler gear 9. Thus, the roller shaft 35 of the sheet conveying rollers 3 and the shaft of the auger 5 can be driven by the same drive source, that is, the sheet feeding motor 10.

As described above, the one-way clutch (roller clutch) 8*c* is inserted into the double gears 8*b* of the idler unit 8 with pressure. In order not to reverse the sheet conveying rollers 3 when the sheet conveying rollers 3 form a loop of a sheet, when the roller shaft 35 is about to rotate in the direction opposite from the drive direction, the one-way clutch is locked with respect to the shaft 8*d* of the idler unit 8 so as not to rotate the roller shaft 35 and the sheet conveying rollers 3. Thus, the one-way clutch 8*c* acts as a reverse preventing mechanism configured to prevent the roller shaft 35 from being rotated in a reverse direction. By this arrangement, because a radial load exerted on the shaft 8*d* of the idler unit 8 is minimized, the shaft 8*d* may be formed from a material such as stainless, and steel such as nickel-plated mild steel (SUM), which need not be subjected to quench hardening.

The combination of the helical gears 6 and 8*b*1 constructs a reduction mechanism configured to reduce a rotational speed of the one-way clutch 8*c* to be lower than a rotational speed of the roller shaft 35. With the reduction mechanism, a frictional force between the shaft 8*d* and the one-way clutch 8*c* decreases, so that the abrasion of the shaft 8*d* can be lessened.

Even if the shaft 8*d* is subjected to a surface hardening processing, the surface hardening processing for the shaft 8*d* can be performed at a low cost, as the axial length of the shaft 8*d* is only slightly longer than that of the double gears 8*b*. As the idler unit 8 is unitized as described above, in the event of failure of the one-way clutch 8*c*, for example, the idler unit 8 can be repaired just by replacing the one-way clutch 8*c*, thereby allowing easy maintenance.

When a sheet is fed by the manual feeding roller 21 without being conveyed by the sheet conveying rollers 3, the drive force of the sheet feeding motor 10 is transmitted to the auger 5 of the waste toner tank 1 by turning on the electromagnetic clutch 11 at a predetermined timing.

In the above-described embodiments, the drive force transmitting direction of the roller shaft 35 is set to be substantially orthogonal to the drive force transmitting direction of the shaft of the auger 5. Therefore, a twist angle of each of the helical gears 6 and 8*b*1 is set to about 45 degrees. However, the twist angle of each of the helical gears 6 and 8*b*1 may be changed according to a relative angle between the respective drive force transmitting directions of the roller shaft 35 and the shaft of the auger 5, that is, according to a positional relationship between the roller shaft 35 and the shaft of the auger 5.

According to the embodiments of the present invention, the one-way clutch 8*c* and the roller shaft 35 of the sheet conveying rollers 3 are not in a coaxial relationship. By this arrangement, the roller shaft 35 is not abraded at the attachment portion of the one-way clutch 8*c*, and the durability of the roller shaft 35 can thereby be enhanced. Therefore, the roller shaft 35 need not be formed from a material having a high hardness, and can be formed from a low-cost material.

In the above-described embodiments, when a rotational force of the roller shaft 35 is transmitted from the helical gear 6 attached on the end portion of the roller shaft 35 to the helical gear 8*b*1 of the idler unit 8, the rotational speed of the one-way clutch 8*c* is reduced to be lower than the rotational speed of the roller shaft 35. Accordingly, a frictional force exerted on the shaft 8*d* can be decreased. Consequently, the abrasion of the shaft 8*d* at the attachment portion of the one-way clutch 8*c* can be minimized, and abrasion powders are not significantly produced. Thus, the durability of the one-way clutch 8*c* can be enhanced.

A generally-used shaft is formed from steel such as nickel-plated mild steel (SUM). However, a shaft used for a one-way clutch is often formed from an expensive stainless material or a special stainless material subjected to quench hardening to increase the hardness of the shaft. If a plated shaft is used for a one-way clutch, a plating layer is removed from the shaft due to contact with the one-way clutch, causing a lock failure. However, if the rotational speed of and the radial load exerted on a shaft used for a one-way clutch is low, the shaft can be formed from steel such as nickel-plated mild steel (SUM) as similarly in the generally-used shaft.

Further, in the above-described embodiments, because the auger 5 obtains a drive force by the rotations of the roller shaft 35, a drive source for driving the auger 5 need not be disposed independently. Therefore, the cost of the image forming apparatus can be decreased. As described above, the roller shaft 35 of the sheet conveying rollers 3 is connected to the shaft of the auger 5 via the idler unit 8, and they are in a substantially orthogonal positional relationship. In this arrangement, the drive source for driving the roller shaft 35, namely the sheet feeding motor 10, is provided on the side opposite from the side where the idler unit 8 is provided in a direction of the shaft line of the roller shaft 35. Thus, a drive mechanism, for example the drive system 25 for driving the image forming device and the sheet feeding motor 10 for driving the sheet feeding roller 13 and the roller shaft 35 of the sheet conveying rollers 3, can be concentrated on the same side surface side of the main body frame 2 in the image forming apparatus, achieving a space-saving configuration of the image forming apparatus.

Moreover, according to the embodiments of the present invention, the one-way clutch 8*c* is provided in the idler unit 8 to act as a reverse preventing mechanism configured to prevent the roller shaft 35 and the sheet conveying rollers 3 from being rotated in a reverse direction. Thus, the roller shaft 35 is not abraded by the reverse preventing mechanism (i.e., the one-way clutch 8*c*), and therefore the durability of a sheet conveying mechanism can be enhanced. The idler unit 8 acts as a drive force transmitting unit connecting the roller shaft 35 (first shaft) to the shaft (second shaft) of the auger 5 via the idler unit 8 to transmit the drive force of the sheet feeding motor 10 from the roller shaft 35 to the shaft of the auger 5.

The present invention has been described with respect to the exemplary embodiments illustrated in the figures. However, the present invention is not limited to these embodiments and may be practiced otherwise.

In the above-described embodiments, the drive force of the sheet feeding motor 10 is transmitted from the roller shaft 35 (first shaft) to the shaft (second shaft) of the auger 5 that moves waste toner, via the idler unit 8. In another embodiment, the drive force of the sheet feeding motor 10 may be transmitted from the roller shaft 35 to a shaft of the transfer roller 26, the fixing roller 27*a*, the sheet discharging rollers 28, or any other roller used in the image forming apparatus. Further, the reverse preventing mechanism of the present embodiment can be applied to any roller shaft that is desirable to be prevented from being reversed.

Moreover, aspects of the present invention can be applied to any type of image forming apparatus, such as, a copying machine, printer, facsimile machine, a multi-functional image forming apparatus, etc.

Numerous additional modifications and variations of the present invention are possible in light of the above teachings. It is therefore to be understood that within the scope of the appended claims, the present invention may be practiced otherwise than as specifically described herein.

The invention claimed is:

1. A drive device, comprising:

a first shaft;

a second shaft disposed at a position deviated from a shaft line of the first shaft;

a drive source configured to drive the first shaft to rotate;

a first gear attached to one end of the first shaft; and a drive force transmitting unit (1) connecting the first shaft to the second shaft through the drive force transmitting unit, (2) connected to the first gear, and (3) including a single unit of a third shaft and second and third gears attached on the third shaft through a one-way clutch, and a bracket to which the third shaft of the single unit is fixed, the drive force transmitting unit to transmit a drive force of the drive source from the first shaft to the first, second and third gears and to the second shaft, the drive force transmitting unit including the one-way clutch connected to the third shaft and configured to lock the second and third gears so as to prevent the first shaft from being rotated in a reverse direction, wherein the bracket includes first and second supporting bracket elements with a space therebetween, and the third shaft attaches to the first supporting bracket element and passes through the second supporting bracket element and the one-way clutch and the second and third gears are attached to the third shaft in the space between the first and second supporting bracket elements.

2. The drive device according to claim 1, wherein the drive force transmitting unit further includes a reduction mechanism configured to reduce a rotational speed of the one-way clutch to be lower than a rotational speed of the first shaft.

3. The drive device according to claim 1, wherein the drive source is provided on a side opposite from a side where the drive force transmitting unit is provided in a direction of the shaft line of the first shaft.

4. The drive device according to claim 1, wherein the third gear has a diameter smaller than a diameter of the second gear, and wherein the drive force transmitting unit further comprises:

the first gear provided engaging the second gear; and a fourth gear provided on the second shaft and that engages the third gear.

5. The drive device according to claim 4, wherein the first and second gears include helical gears each having a twist angle, and a positional relationship between the first shaft and the second shaft is determined based on the twist angles of each of the helical gears with respect to a rotational axis of each of the helical gears.

6. The drive device according to claim 1, wherein the first shaft and the second shaft are in a substantially orthogonal positional relationship.

7. The drive device according to claim 1, wherein the first and the third shaft are at a cross positional relationship of about 90 degrees to each other.

8. A drive device, comprising:

a first shaft;

a second shaft disposed at a position deviated from a shaft line of the first shaft;

means for driving the first shaft to rotate;

a first gear attached to one end of the first shaft; and means for transmitting a drive force of the means for driving from the first shaft to the second shaft and to the first gear and including a single unit of a third shaft and second and third gears attached on the third shaft through a one-way clutch, and a bracket to which the third shaft of the single unit is fixed, the means for transmitting connecting the first shaft to the second shaft through the means for transmitting and, the one-way clutch connected to the third shaft to lock the second and third gears so as to prevent the first shaft from being rotated in a reverse direction, wherein the bracket includes first and second supporting bracket elements with a space therebetween, and the third shaft attaches to the first supporting bracket element and passes through the second supporting bracket element and the one-way clutch and the second and third gears are attached in the third shaft in the space between the first and second supporting bracket elements.

9. The drive device according to claim 8, wherein the means for transmitting further includes means for reducing a rotational speed of the one way clutch to be lower than a rotational speed of the first shaft.

10. The drive device according to claim 8, wherein the first shaft and the second shaft are in a substantially orthogonal positional relationship.

11. The drive device according to claim 8, wherein the first and the third shaft are at a cross positional relationship of about 90 degrees to each other.

* * * * *